US007073223B2

(12) United States Patent
Huza

(10) Patent No.: US 7,073,223 B2
(45) Date of Patent: Jul. 11, 2006

(54) FLATULENCE FILTER SEAT CUSHION FOR ABSORBING ODOR AND PROVIDING SOUND ATTENUATION FROM AN ANAL DISCHARGE OF A SEATED INDIVIDUAL

(76) Inventor: James P. Huza, 1804 Plantation Cir., Greenville, NC (US) 27858

( * ) Notice: Subject to any disclaimer, the term of this patent is extended or adjusted under 35 U.S.C. 154(b) by 228 days.

(21) Appl. No.: 10/627,284

(22) Filed: Jul. 25, 2003

(65) Prior Publication Data

US 2005/0015882 A1 Jan. 27, 2005

(51) Int. Cl.
*A47C 7/18* (2006.01)

(52) U.S. Cl. ..... 5/653; 5/652.1; 5/655.9

(58) Field of Classification Search ..... 5/653, 5/641, 652.1, 655.9, 411, 490, 738
See application file for complete search history.

(56) References Cited

U.S. PATENT DOCUMENTS 1,349,258 A * 8/1920 Blocksom ..... 5/490
3,638,255 A * 2/1972 Sterrett ..... 5/641
4,031,579 A * 6/1977 Larned ..... 5/652.1
4,064,578 A * 12/1977 Yamada ..... 297/452.27
4,182,335 A 1/1980 Matrullo
5,111,544 A * 5/1992 Graebe ..... 5/654
5,568,660 A * 10/1996 Raburn et al. ..... 5/652.1
5,593,398 A 1/1997 Weimer
5,665,081 A 9/1997 Grosse
6,313,371 B1 11/2001 Conant et al.
6,760,937 B1 * 7/2004 Ou ..... 5/652.1

* cited by examiner

*Primary Examiner*—Michael Trettel
(74) *Attorney, Agent, or Firm*—Caesar, Rivise, Bernstein, Cohen & Pokotilow, Ltd.

(57) ABSTRACT

The present invention 100 discloses a flatulence filter seat cushion for absorbing odor and providing sound attenuation from an anal discharge of a seated individual. The flatulence filter seat cushion is primarily comprised of an exterior cotton fabric casing with an unlimited design 101, 102 sewn together along perimeter sides with a predetermined pore opening to aid in flatus diffusion; a predetermined, replaceable sound dampening/air diffusing and/or odor removal element 105 and a replaceable odor removal element 106. The said replaceable filter elements are inserted through a zippered opening 103 in the bottom of an exterior shell 102. A hook and loop fastener 104 is applied on both sides 102 to retain the flatulence filter seat cushion in position while one is seated. A predetermined material of polyurethane foam construction 105 may be impregnated with a blend of activated carbon for additional odor removal. A replaceable odor removal element 106 utilizing a plurality of filter mediums in a sandwich type bonded arrangement and/or a non-woven fabric impregnated with a specialty blend of activated coconut shell carbon or zeolites or activated alumina used alone or in combination thereof for flatulence odor removal.

13 Claims, 1 Drawing Sheet

FLATULENCE FILTER SEAT CUSHION FOR ABSORBING ODOR AND PROVIDING SOUND ATTENUATION FROM AN ANAL DISCHARGE OF A SEATED INDIVIDUAL

CROSS-REFERENCE TO RELATED APPLICATIONS

Not applicable

BACKGROUND

1. Field of Invention

This invention relates to a flatulence filter seat cushion, specifically for the absorption of foul smelling human flatus and flatus sound attenuation.

2. Description of Prior Art

Heretofore, the average person produces two to three pints of gas daily, which leaves the body in the form of belching or flatus. On average, a flatus outburst for a normal person ranges from 10 to 20 occurrences per day. However, sufferers of Irritable Bowel Syndrome, Diabetes, Diverticulitis and other gastrointestinal ailments can produce far more gas, with more odors and emit it much more frequently. To minimize the effects of flatus a portable flatulence filter seat cushion incorporating replaceable odor and sound filtration was invented. The said cushions are typically used at home, in office environments, for wheelchair patients, while traveling in the car, train, plane, and sporting events or for that special gift-giving occasion.

There are other protective devices for protecting against, filtering and/or capturing intestinal gas or flatus. Typical of these is U.S. Pat. No. 5,593,398 issued to Chester L. Weimer on Jan. 14, 1997.

Another patent was issued to C. James Matrullo on Jan. 8, 1980 as U.S. Pat. No. 4,182,335. Yet another U.S. Pat. No. 6,313,371 was issued to Conant, et al. on Nov. 6, 2001 and still yet another was issued to Kenneth J Grosse on Sep. 9, 1997 as U.S. Pat. No. 5,665,081

U.S. Pat. No. 5,593,398

Inventor: Chester L. Weimer

Issued: Jan. 14, 1997

Protective underwear made of airtight polyurethane-coated nylon with elastic sewn around the waist and around the bifurcated legs. An exit hole for the flatus is cut from the back, near the bottom, of the underwear. The exit hole is covered with a pocket made of porous fabric, and designed in the same shape as the exit hole, only larger. The bottom layer of the pocket is sewn around the edge of the exit hole connecting it to the underwear. The top layer is sewn around the edge of the bottom layer and onto the underwear, except at the top, leaving the pocket opening. The pocket opening is kept closed by a fastener. The replaceable filter is large all around than the exit hole, but smaller all around than the pocket. The top and bottom layers are of wool felt; and both layers are cut larger than all other layers to facilitate sewing. The second layers, on top and bottom, are of polypropylene non-woven fabric followed by layers, top and bottom, of fiber glass wool. In the middle of the filter is a single layer of activated carbon.

Underwear of this design creates an uncomfortable feeling for the end user resulting in sweating from airtight materials used. Sound attenuation is also not addressed.

U.S. Pat. No. 4,182,335

Inventor: C. James Matrullo

Issued: Jan. 8, 1980

An anal filter for protecting underwear from soiling, is attached to a person's anus solely by non-adhesive adherence to the anus and adjacent portions of the buttocks, due to a facing of fluffy fibrous material, and when attached, serves as a filter by being pervious to the discharge of gas through the anus but substantially impervious to complete passage of excreta by the gas or remaining on the anus from a bowel movement. A layer may be adhesively secured to the fibrous material and which prior to use of the anal filter can be pulled off from the fibrous material while pulling this material's fibers outwardly so as to give the material its fluffy characteristic.

U.S. Pat. No. 6,313,371

Inventor: Conant, et al

Issued: Nov. 6, 2001

A flatulence deodorizer pad to be worn by a user for absorbing gas due to flatulence. The pad is constructed of activated charcoal cloth disposed between a pair of laminations or layers having multiple perforations therein. The pad is non-intrusively taped inside briefs or panties in the anal area using double-sided adhesive tape.

The flatulence pad does not address sound attenuation. Flatus deflection will occur permitting a portion of the flatus odor to bypass the filter pad.

U.S. Pat. No. 5,665,081

Inventor: Kenneth J Grosse

Issued: Sep. 9, 1997

A pad for attenuating sound and absorbing odors from an anal region of an individual. The inventive device includes a pad member containing a volume of odor-absorbing granulated charcoal covered by a layer of filler material and encapsulated with a flexible web. A gluteus insert extends from the pad for positioning between the gluteus-maximus muscles and against the anal region of the user to attenuate noise emanating therefrom.

Flatus deflection will occur permitting a portion of the flatus odor to bypass the filter pad.

While these devices may be suitable for the purposes for which they were designed, they would not be as suitable for the purposes of the present invention, as hereinafter described.

SUMMARY

In accordance with the present invention a flatulence filter seat cushion comprises a permeable material forming a shell having an opening whereby a sound attenuating polyurethane foam filter and odor absorbing fabric filter are inserted.

OBJECTS AND ADVANTAGES

Accordingly, besides the objects and advantages of the flatulence filter seat cushion described in my above patent, several objects and advantages of the present invention are:

(a) to provide a new flatulence filter seat cushion wherein the same can be utilized for muffling sound and absorbing odor from a posterior anal region of an individual while seated.

(b) to provide a new flatulence filter seat cushion with an exterior shell using fabric material of various designer patterns with a sufficient range of openings per square inch to diffuse the flatus outburst.

(c) to provide a new flatulence filter seat cushion with an exterior shell which incorporates a zipper opening for the ease of replacement of the internal sound and odor filter.

(d) to provide a new flatulence filter seat cushion with an exterior shell which is washable and reusable.

(e) to provide a new flatulence filter seat cushion with a polyurethane open cell foam with a decahedron 3D cross section to facilitate sound dampening and flatus diffusion.

(f) to provide a new flatulence filter seat cushion with a polyurethane foam that meets California TB 117 flammability requirements.

(g) to provide a new flatulence filter seat cushion with a layer of odor absorbing fabric comprised of a flexible activated charcoal fabric having a surface area in square meters per gram between about 800 and about 1100.

(h) to provide a new flatulence filter seat cushion for absorbing odor and providing sound attenuation of intestinal gas or flatus while seated that will be most effective.

(i) to provide a new flatulence filter seat cushion for absorbing odor and providing sound attenuation of intestinal gas or flatus that is discrete and portable.

(j) to provide a new flatulence filter seat cushion for absorbing odor and providing sound attenuation of intestinal gas or flatus that is inexpensive to purchase.

Still further objects and advantages will become apparent from a consideration of the ensuing description and drawing.

The present invention overcomes the shortcomings of the prior art by providing the present invention, the flatulence filter seat cushion is portable and the first product of its kind to use a top and bottom layer of permeable fabric material to form a shell which also provides flatus diffusion by the plurality of openings in the fabric material. The shell assembly incorporates a zipper opening on the bottom whereby the odor and sound attenuation filters can be replaced while the said fabric shell assembly can be washed and reused and fresh sound attenuation and odor filters inserted. The sound attenuation polyurethane open cell foam with a decahedron 3D cross section is used to facilitate sound dampening and flatus diffusion. The odor filter comprised of a flexible activated charcoal fabric having a surface area in square meters per gram between about 800 and about 1100 and is made from coconut shell activated carbon because of its high micro porosity.

The foregoing and other objects and advantages will appear from the description to follow. In the description reference is made to the accompanying drawing, which form a part hereof, and in which is shown by way of illustration specific embodiments in which the invention may be practiced. These embodiments will be described in sufficient detail to enable those skilled in the art to practice the invention, and it is understood that other embodiments may be utilized and that structural changes may be made without departing from the scope of the invention.

DRAWING FIGURES

In the accompanying drawing, like reference characters designate the same or similar parts throughout the several views.

REFERENCE NUMERALS IN DRAWINGS

Figure 1:
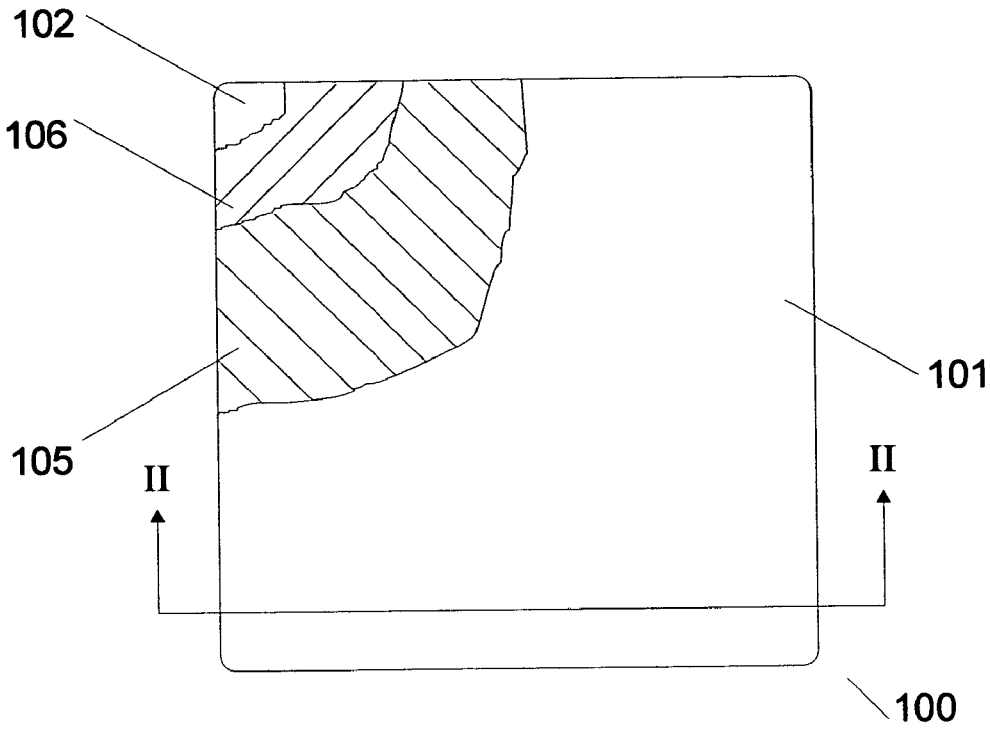
FIG. 1 shows a plan view of a flatulence filter seat cushion for flatulence odor and sound attenuation of a sitting human according to the invention.

100 flatulence filter seat cushion
101 exterior top cotton fabric material
102 exterior bottom cotton fabric material
103 bottom opening with zipper fastener
104 hook and loop self adhesive fastener
105 polyurethane foam sound dampening filter
106 odor absorbing fabric

DESCRIPTION

Figure 2:
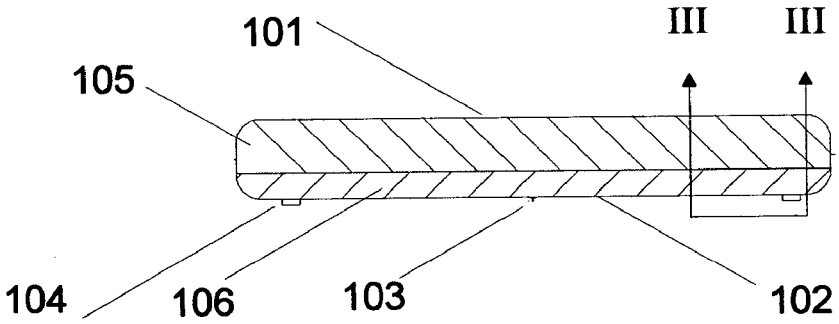
FIG. 2 is a lateral cross-section through the flatulence filter seat cushion.
Figure 3:
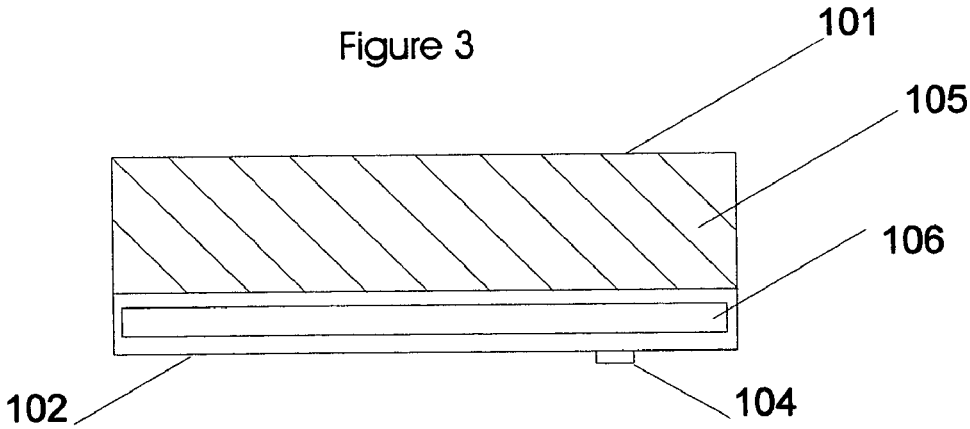
FIG. 3 is a lateral cross-section through the discrete flatulence filter seat cushion at FIG. 2.

FIGS. 1, 2 and 3—Preferred Embodiment

Referring to drawing I—I wherein the showings are for purposes of illustrating a preferred embodiment of the invention only and not for purposes of limiting the invention, FIG. 1 shows a plan view of a flatulence seat cushion for flatulence odor and sound minimization 100 of a sitting human according to the invention. The said cushion is primarily comprised of an exterior cotton fabric casing with an unlimited design 101, 102 sewn together along perimeter sides with a predetermined pore opening to aid in flatus diffusion; a predetermined, replaceable sound dampening/air diffusing and/or odor removal element 105 and a replaceable odor removal element 106.

FIG. 2 is a lateral cross-section through the flatulence seat cushion 100. The said replaceable items are inserted through a zippered opening 103 in the bottom of an exterior shell 102. A hook and loop fastener 104 is applied on both sides 102 to retain the flatulence seat cushion in position while one is seated.

FIG. 3 is a lateral cross-section through discrete seat cushion 100 at FIG. 2 showing predetermined replaceable sound dampening/air diffusing and/or odor removal element 105. A predetermined material of polyurethane foam construction may be impregnated with a specialty blend of activated carbon for odor removal. A replaceable odor removal element 106 utilizing a plurality of filter mediums in a sandwich type bonded arrangement and/or a non-woven fabric impregnated with a specialty blend of activated coconut shell carbon or zeolites or activated alumina used alone or in combination thereof for flatulence odor removal.

OPERATION

In operation the sitting human uses the flatulence seat cushion with replaceable elements in a normal manner with zipper located away from the human bottom to minimize the odor and sound effects of flatulence. When utilized, several effects increase its effectiveness while minimizing human embarrassment;

(1) The flatulence exterior seat shell 101, 102 is made from a fabric encapsulating the replaceable working parts of the cushion.

(2) Flatulence sound dampening/air diffusion/odor abatement is minimized by a replaceable polyurethane foam element 105.

(3) Flatulence odor is minimized by means of replaceable filter odor element(s) 106.

CONCLUSION, RAMIFICATIONS, AND SCOPE

Accordingly, the reader will see that the flatulence filter seat cushion for absorbing odor and providing sound attenuation provides a reliable means for passing intestinal gas by a human in a seated position.

While this invention is primarily designed as an aid to the millions of people suffering from various medical conditions such as Irritable Bowel Syndrome, Cirrhosis of the Liver, Colon or Rectal Cancer, Crohn's Disease, Diabetes, Gallstones, Parasitic Infections, it can also be used to control second hand flatulence by all segments of the population.

Although the description above contains many specificities, these should not be construed as limiting the scope of the invention but as merely providing illustrations of some of the presently preferred embodiments of this invention. For example, the flatulence filter seat cushion can have other shapes, such as circular, oval etc.

Thus the scope of the invention should be determined by the appended claims and their legal equivalents, rather than by examples given.

I claim:

1. A flatulence filter seat cushion for absorbing odor and providing sound attenuation from an anal discharge of a seated individual, comprising:

a) a first layer of permeable material of a predetermined size;

b) a layer of polyurethane foam having a predetermined cross-sectional shape;

c) a layer of odor absorbing fabric having a predetermined cross-sectional shape;

d) a second layer of permeable material of a predetermined size; and e) a zipper having an opening, wherein said first layer of permeable material and said second layer of permeable material are stitched about a periphery of said first layer and said second layer, said zipper is centrally located on said second layer forming said opening, and said polyurethane foam and said layer of odor absorbing fabric are located inside said opening.

2. The flatulence filter seat cushion of claim 1, wherein said first layer of permeable material and said second layer of permeable material comprise a fabric having a square per inch count between about 50 and about 100.

3. The flatulence filter seat cushion of claim 1, wherein said first layer and said second layer are washable and reusable.

4. The flatulence filter seat cushion of claim 1, further comprising fasteners for minimizing movement of said cushion.

5. The flatulence filter seat cushion of claim 1, wherein said layer of polyurethane foam is an open cell, decahedron 3D shape.

6. The flatulence filter seat cushion of claim 5, wherein said layer of polyurethane foam meets California TB 117 flammability requirements.

7. The flatulence filter seat cushion of claim 1, wherein said layer of odor absorbing fabric is comprised of a flexible activated charcoal fabric.

8. The flatulence filter seat cushion of claim 7, wherein said flexible activated charcoal fabric has a density between about 800 and about 1100 square meters per gram.

9. The flatulence filter seat cushion of claim 1, wherein said cushion is portable.

10. The flatulence filter seat cushion of claim 5, wherein said layer of polyurethane foam is impregnated with activated carbon.

11. The flatulence filter seat cushion of claim 7, wherein said layer of odor absorbing fabric is comprised of at least one of activated coconut shell carbon, zeolites and activated alumina.

12. The flatulence filter seat cushion of claim 1, wherein said second layer of permeable material is a two piece layer.

13. The flatulence filter seat cushion of claim 4, wherein said fasteners are peel-and-stick tape hooks.

* * * * *